US010742338B2

(12) United States Patent
Thramann et al.

(10) Patent No.: US 10,742,338 B2
(45) Date of Patent: Aug. 11, 2020

(54) SEAMLESS INTEGRATION OF RADIO BROADCAST AUDIO WITH STREAMING AUDIO

(71) Applicant: Clip Interactive, LLC, Boulder, CO (US)

(72) Inventors: Jeffrey Thramann, Longmont, CO (US); Peter Shoebridge, Boulder, CO (US); Ben Good, Boulder, CO (US)

(73) Assignee: Clip Interactive, LLC, Boulder, CO (US)

( * ) Notice: Subject to any disclaimer, the term of this patent is extended or adjusted under 35 U.S.C. 154(b) by 0 days.

(21) Appl. No.: 16/258,327

(22) Filed: Jan. 25, 2019

(65) Prior Publication Data

US 2019/0238244 A1 Aug. 1, 2019

Related U.S. Application Data

(60) Provisional application No. 62/622,801, filed on Jan. 26, 2018.

(51) Int. Cl.

| | |
|---|---|
| ***H04H 20/10*** | (2008.01) |
| ***H04H 20/26*** | (2008.01) |
| ***H04H 20/12*** | (2008.01) |
| ***H04H 60/37*** | (2008.01) |
| ***H04H 60/58*** | (2008.01) |
| ***H04H 60/27*** | (2008.01) |

(52) U.S. Cl.

CPC ..... *H04H 20/106* (2013.01); *H04H 20/12* (2013.01); *H04H 20/26* (2013.01); *H04H 60/27* (2013.01); *H04H 60/375* (2013.01); *H04H 60/58* (2013.01)

(58) Field of Classification Search

CPC .... H04H 20/106; H04H 60/58; H04H 60/375; H04H 20/12; H04H 20/26

See application file for complete search history.

(56) References Cited

U.S. PATENT DOCUMENTS

| | | | | |
|---|---|---|---|---|
| 6,704,553 | B1 * | 3/2004 | Eubanks | H03J 1/0058 455/186.1 |
| 7,180,917 | B1 * | 2/2007 | Marko | H04H 20/10 370/319 |
| 2003/0210889 | A1 * | 11/2003 | Engle | H04H 60/375 386/250 |
| 2007/0101360 | A1 * | 5/2007 | Gutta | H04H 20/106 725/34 |

(Continued)

*Primary Examiner* — Ankur Jain

(74) *Attorney, Agent, or Firm* — Perkins Coie LLP

(57) ABSTRACT

Disclosed herein is a music service that enables consumers listen to a broadcast radio station without commercials. The service operates by shifting the source channel of a radio from the broadcast radio to a streaming audio service for the duration of the commercial. In some embodiments, the service utilizes any of: a radio including native firmware/software, a mobile device such as a smart phone executing an application, cooperative integration of a radio and a mobile device, or master/slave relationship between a mobile device and a radio. The mobile device listens to the radio broadcast and determines when to shift between the radio broadcast and the streaming audio via any of audio fingerprint analysis, radio station behavioral analysis, radio station metadata, and/or radio station voice recognition analysis.

15 Claims, 9 Drawing Sheets

(56) References Cited

U.S. PATENT DOCUMENTS

| | | | | |
|---|---|---|---|---|
| 2013/0191866 | A1* | 7/2013 | Khare | G06Q 30/0242 725/36 |
| 2015/0082349 | A1* | 3/2015 | Ishtiaq | H04N 21/23418 725/40 |
| 2015/0375117 | A1* | 12/2015 | Thompson | A63F 13/35 463/9 |
| 2016/0182923 | A1* | 6/2016 | Higgs | H04H 20/106 725/34 |
| 2017/0279549 | A1* | 9/2017 | Kocheisen | H04H 20/103 |
| 2018/0176616 | A1* | 6/2018 | Green | H04N 21/233 |

* cited by examiner

SEAMLESS INTEGRATION OF RADIO BROADCAST AUDIO WITH STREAMING AUDIO

CROSS-REFERENCE TO RELATED APPLICATIONS

This application claims the benefit of and priority to U.S. Provisional Application No. 62/622,801, filed Jan. 26, 2018, entitled Seamless Integration of Radio Broadcast Audio with Streaming Audio, which application is incorporated herein by reference in its entirety.

TECHNICAL FIELD

This disclosure relates to methods and systems for providing audio services. The disclosure more particularly relates to streaming audio and integration with radio broadcasts.

BACKGROUND

Broadcast radio is essentially a one to many medium where music is curated by station programming directors and sent to listeners via their tower. Streaming music is different in that anyone can stream music, but the plays of streaming audio are treated differently from a copyright use perspective. This is why broadcast radio has not completely shifted into streaming.

Consumers want to avoid commercials and they have a number of options to obtain commercial free music. That said, only so many people want to pay the fees for these services and only so many people want to do the work to build playlists, discover music, etc. The vast majority of consumers would prefer to just play a radio station and skip to another station when they hear a song they don't like or when a commercial stop set plays. As a result, many broadcasters have coordinated their commercial stop sets to be played at the same time.

INCORPORATION BY REFERENCE

U.S. Non-Provisional application Ser. No. 15/258,796, filed Sep. 7, 2016, entitled Apparatus, System, and Method for Digital Audio Services, is incorporated herein by reference in its entirety. U.S. Non-Provisional application Ser. No. 15/347,272, filed Nov. 9, 2016, entitled Apparatus, System, and Method for Integrating Content and Content Services, is incorporated herein by reference in its entirety.

DETAILED DESCRIPTION

Disclosed herein is a music service that enables consumers listen to a broadcast radio station just like they do today, but when the station breaks to a commercial stop set, the service recognizes this and replaces the audio channel with streamed songs during the commercial break. The user experience will essentially be the lean back standard radio experience—only without commercials. The service operates on a number of platforms. In some embodiments, the service utilizes any of: a radio including native firmware/software, a mobile device such as a smart phone executing an application, cooperative integration of a radio and a mobile device, or master/slave relationship between a mobile device and a radio.

Streamed audio is music delivered over the Internet. Services that offer streaming audio include Apple®, Spotify®, Pandora®, Slack®, and other similar services known in the art. Broadcast audio is music delivered by broadcasters and is often curated by disc jockeys (DJs) or other radio personalities. Broadcast radio is often implemented with FM or AM radio signals, though other methods exist to broadcasters. While described with respect to broadcast radio, other types of conventional broadcasts, such as television, may benefit from the technology described herein.

In order to carry out the service, the technology does, in certain aspects, the following:

1. "Listen" to broadcast radio stations in real time to learn length and location of commercial stop sets;
2. Determine what station a listener is listening to;
3. When a commercial stop set is identified, trigger the service to switch to streaming music so the broadcast is not heard;
4. When the commercial stop set is over, trigger the broadcast to resume play; and
5. Smoothing/refining the handoff transition between the broadcast radio and the audio stream over time, for each station.

Figure 1:
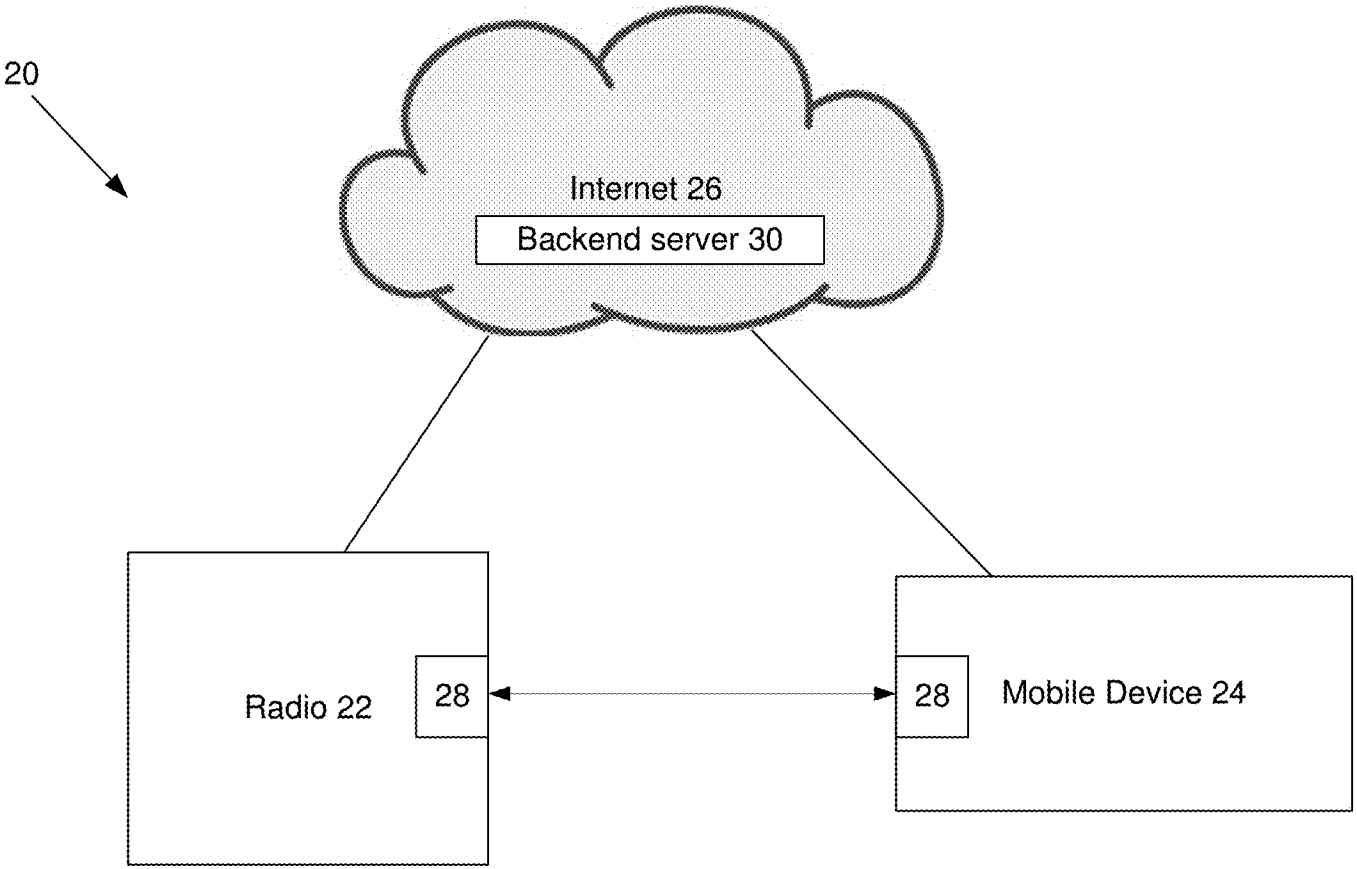
FIG. 1 is a block diagram of a system for integrating broadcast audio with streaming audio to remove commercial content.

FIG. 1 is a block diagram of a system 20 for integrating broadcast audio with streaming audio to remove commercial content. Those components may include any combination of a radio or "head unit" 22 and a mobile device 24. Radios 22 includes devices such as car stereo systems (head units), home entertainment systems, portable radios, etc. capable of receiving signals in AM/FM bands, satellite radio (XM), or connecting to rebroadcasts of AM/FM/XM signals via other connective means known in the art. The mobile device 24 includes devices such as cell phones, smart phones, tablets, personal/home assistants, laptops, and other network connected devices. Each of the radio 22 and the mobile device 24 may include wireless transceivers or signal connectivity traditionally associated with the other respective device (e.g., some smartphones receive FM signals, while some radios have connectivity to the Internet). The system 20 can operate with one or both of the radio 22 and the mobile device 24.

The system 20 further includes a connection to the internet 26. This connection may be wireless or wired. In embodiments including both a radio 22 and a mobile device 24, a communications interface 28 enables communication between the radio 22 and the mobile device 24. The communications interface 28 may include any of: a wired connection via auxiliary coaxial cable, a wired connection via USB cable, wireless communication via machine-to-machine protocols (e.g., Bluetooth, Bluetooth Low Energy, Zigbee, Z-wave, etc.), wireless communication via network protocols (e.g., Wireless Fidelity, cellular networks, etc.), or other suitable communication methods known in the art and equivalents thereof. In one aspect, the communications interface 28 may be a personal FM transmitter coupled to the mobile device 24. The personal FM transmitter enables the mobile device 24 to broadcast an FM signal that is receivable by the radio 22, or other FM radios/speakers within range. Based on the communications interface 28, the system 20 establishes either a master/slave or communicative relationship between the radio 22 and the mobile device 24.

A person of skill in the art readily appreciates that car radios and other broadcast devices may have to be modified to interact with mobile devices as described or to store content. Broadcast devices can include wireless communications interfaces that can receive content through radio-based communications, like Bluetooth or cellular communications, IP-based communications, infrared communications, personal FM transmitters, or some other method. Broadcast devices can include wired communications interfaces as well, including Ethernet or other IP-based communications, USB or other IEEE-standard wired communications, or some other wired communications method. In another embodiment, the "streamed audio" content can be downloaded to the device temporarily. In yet another embodiment, the content can be streamed to a second device.

Figure 2:
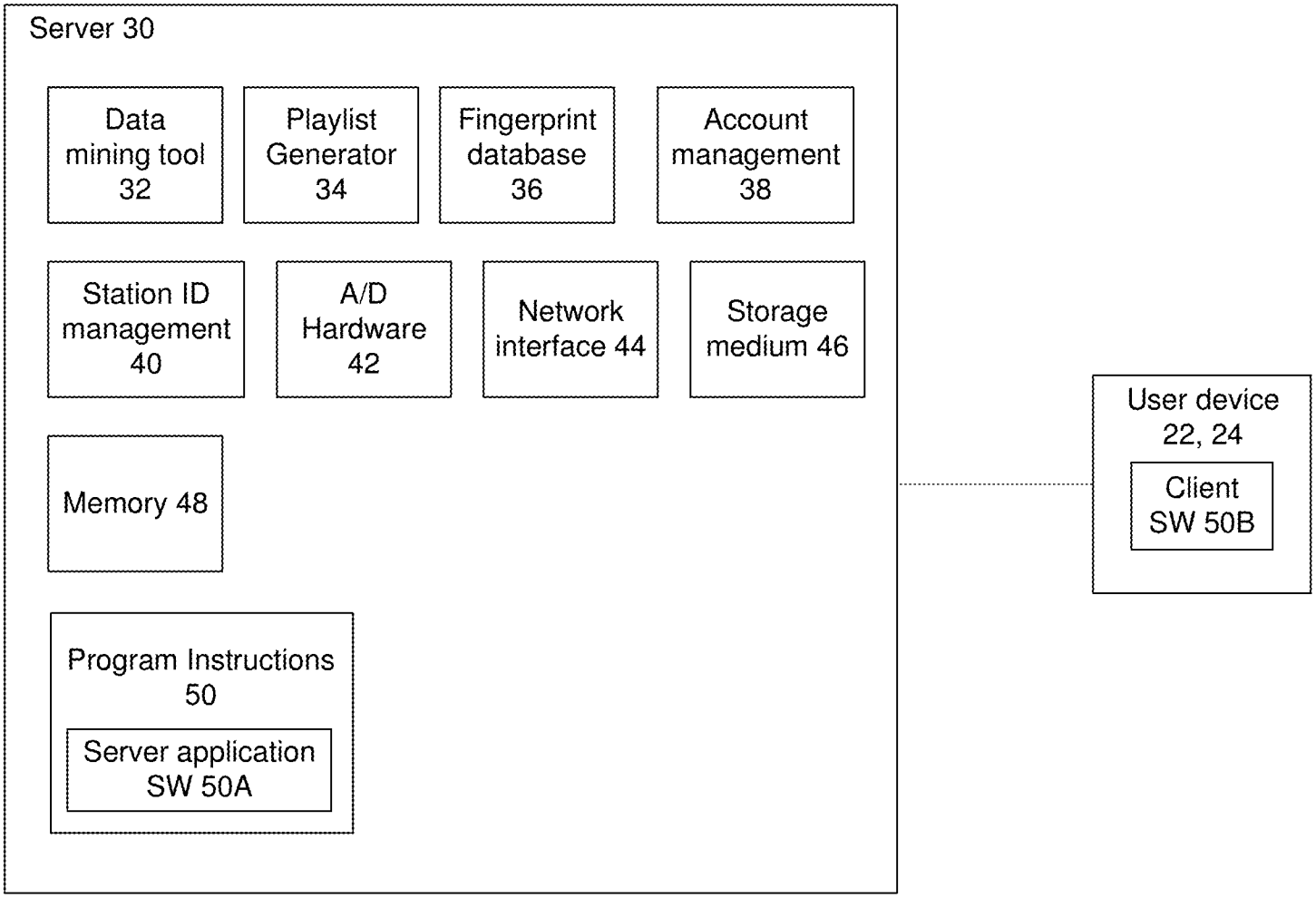
FIG. 2 is a block diagram of a backend server for integrating broadcast audio with streaming audio to remove commercial content.

FIG. 2 is a block diagram of a backend server 30 for integrating broadcast audio with streaming audio to remove commercial content. The embodiment shown in FIG. 2 illustrates high-level components and modules of a back end server 30 for conducting management of the system 20 of FIG. 1. Each of the components and modules of FIG. 2 as well as other components of the system described herein can be implemented in hardware or a combination of hardware and software or firmware. For example, each of the data mining tool 32, playlist generator 34, account management 38, station ID management 40, and A/D hardware 42, can be so implemented.

FIG. 2 illustrates an embodiment of specially-programmed computer 30 that can implement one or more of the foregoing components. Such a computer 30 can include a network communications interface 44, storage medium 46, memory 48, program instructions 50, and processor 52. Program instructions/server side application 50A can be used to implement one or more of the components or portions of components of the system 20. Server application software 50A communicates with client application software 50B. Moreover, in some embodiments, additional hardware components of computer 30 can be included that implement one or more of the components or portions of components of the system 20.

The storage medium 46 is can be a hard disk drive, but this is not required, and one of ordinary skill in the art will recognize that other storage media may be utilized without departing from the scope of the present invention. In addition, one of ordinary skill in the art will recognize that the storage medium 46 which is depicted for convenience as a single storage device, may be realized by multiple (e.g., distributed) storage devices.

Each of the components and modules described herein can be implemented in custom hardware or as program instructions in computer memory that are executed by a processor, the program instructions being stored in a storage medium such as a hard disk drive, flash memory, or optical disc. Each of the components and modules of FIG. 2 can be organized into modules that are further integrated or modularized.

The audio of music/songs or advertisements can be stored in a fingerprint database 36, (e.g., Audible Magic Ad Database, Gracenote, etc.). A person of skill in the art appreciates that a different database to store media content can be used, including a database managed by a content provider or third party (e.g., Shazam). The details of a particular user's taste in music can be stored in the user-account database 38. In some embodiments, a user can select to receive an advertisement rather than switch to a streaming service. In still other embodiments, a user may select to receive advertisements, or ads, from a content provider on the mobile device, while still switching to a streaming audio service, (e.g., click on the ad or related URL) and be presented with a web page of the content provider (e.g., advertiser or broadcaster).

When a user interacts with the user app 50B, the radio 22 or mobile device 24 records a snippet of audio and transmits to the data mining tool 32. Audio can originate from a TV, radio, car radio, internet radio, satellite radio, stereo receiver, computer, or some other device that can receive broadcast content, audio over IP, or some other audio reception technique. For example, other audio devices include a sling box, portable stereo, hand-held audio devices such as an iPod, iPhone, or some other smartphone-like device. In another embodiment, the devices 22, 24 that executes the user app 50B may also be the device that receives and plays the content.

In some embodiments, the station ID management 40 is constantly listening and collecting audio from radio stations of interest (via the A/D hardware 42). The Station ID management 40 generates a profile for each station based on observed behavior and uses machine learning models (hidden Markov models) to predict station behavior (e.g., length of commercial breaks, length of music sets, type of music played, etc.). In some embodiments, the station ID management 40 buffers the last few minutes of audio for each station. The station ID management 40 can identify the radio station being listened to by, for example, comparing the app-user audio to the buffered radio station audio using algorithms described below. The station ID management 40 then returns the radio station ID.

The playlist generator 34 determines which songs to stream based on the radio station to which the user is listening. The songs selected are determined based on both style and length, e.g., the service is designed to provide users with songs they like, and to optimize the songs played during the time block occupied by the commercial set. Based on learned models of a given station's behavior (e.g., for time of day/week/year and active DJ) the length of commercial breaks can be estimated. Ideally, streamed audio takes up the entire commercial break exactly without impinging on time broadcast audio music is played. Further, based on copyright payment models, it is ideal to play as few songs during the commercial break as possible (e.g., songs are paid for on a per play basis).

In some embodiments, error in timing is unavoidable, and the playlist generator 34 can be optimized for cutting off either the streamed audio or rejoining the broadcast audio in the middle of a current song. The playlist generator 34 is programmed to include some song variation such that it is not slavish to exact matching a commercial break in a manner that reuses the same streamed song, or set of songs, for every commercial break. That creates a poor user experience in the same manner that commercials are annoying.

Figure 3:
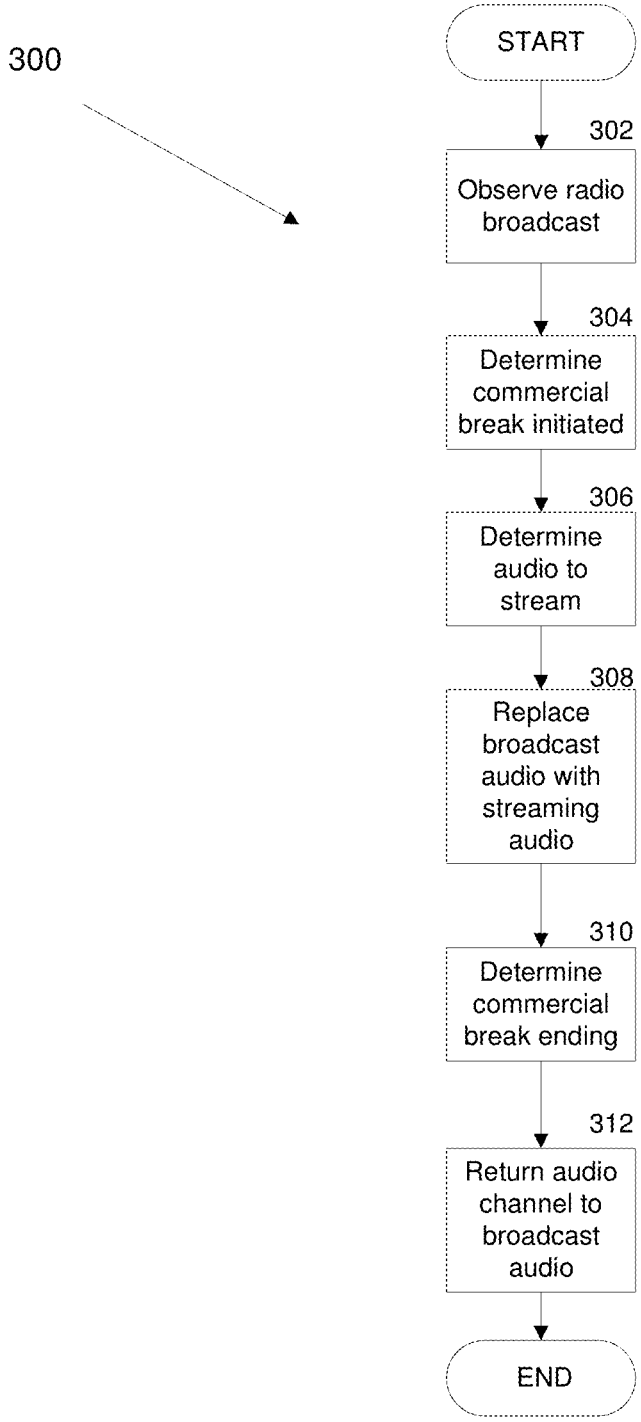
FIG. 3 is a flowchart illustrating a method for integrating broadcast audio with streaming audio to remove commercial content.

FIG. 3 is a flowchart illustrating a method for integrating broadcast audio with streaming audio to remove commercial content. In step 302, the service observes an active radio broadcast. Depending on the active embodiment, "observation" is carried out in different ways. There are a number of input signals that can be observed. These input signals can be used in singular or combination. One input signal is the audio of the broadcast itself. The audio has a number of characteristics that can be listened to and the audio can be fingerprinted. Using fingerprints, the system can determine what is being played at a given moment and when that song or advertisement will end. In certain aspects, the observation is integration with the stations broadcast trafficking system to receive a signal at the mobile device that a stop set is upcoming in the broadcast signal.

Another input signal is based on the audio of the broadcast but uses a different analysis—rather than fingerprinting, the audio can be interpreted via speech and/or speaker recognition. For example, if a DJ says "we're going to play three songs before going to commercial" the system 20 can interpret that speech and expect to identify three songs and the commercials. Further, this analysis can be used to determine how often a particular DJ shifts from commercials to a "cold open" into a song, or how long the DJ often speaks when heading into or out of a commercial break.

A third input signal is the Radio Data System or Radio Broadcast Data System (RDS, RBDS) which provides metadata regarding what is being broadcast at a given moment by the radio station. The observations generate a profile for a given station that enables the system to predict future behavior of that station based on past behavior. The observation step may comprise on-going, real-time observations and/or make use of past recordings to develop trained models.

Each of these input stream enables the generation of a behavioral model for a given radio station. Behavioral models enable prediction of future behavior for the specific station. The radio station further may be identified by each of these same input streams (speaker recognition of a given DJ, speech recognition of station identification, fingerprint of station identification, and/or broadcast metadata).

In step 304, the system determines when a commercial break is initiated. This determination is based on the observations and trained models of step 302. When input streams indicate that a commercial is playing or coming, the system determines that a commercial break has been initiated or will initiate in a particular amount of time.

Input streams can be combined to improved effect. Returning to the example above where the system recognizes the DJ saying that there are three songs until a commercial, the system can expect to count three song fingerprints. Then, using the third song fingerprint, determine a length of the third song and therefore the time that the third song will complete. The system then determines that a commercial break will begin at the known time the third song completes.

In step 306, the system determines what songs to stream. The songs selected are determined based on both style and length. If the radio station the user is listening to is a classic rock station, the system will select from classic rock songs. Secondly, the songs selected are selected based on the expected length of the commercial break. The expected length is based on learned models of a given station's behavior from step 302. In certain embodiments, the expected length of a commercial break may be a predetermined amount of time, such as, 2, 3.5, 5 minutes or the like.

Ideally, streamed audio takes up the entire commercial break exactly without impinging on songs selected by the DJ of the broadcast station. It is also ideal to play as few songs during the commercial break as possible. Some error in timing is inevitable, and the playlist generator can be optimized for cutting off either the streamed audio or rejoining the broadcast audio in the middle of a current song. The playlist generator is programmed to include some song variation such that it is not slavish to exact matching a commercial break in a manner that reuses the same streamed song, or set of songs, for every commercial break. That creates a poor user experience in the same manner that commercials are annoying.

In some embodiments, selecting the streamed audio further entails modifying the songs selected. For example, in order to change the length of a given song, the system may repeat segments of the song, extend intros and endings, speed up or slow down play of the song in order to match to a broadcast song break. In order to modify songs, the songs selected are broken down into segments (e.g., intro, outro, chorus, etc.) labeled with metadata that enables ease of extension or modification. In some embodiments, the song selection is handled by a third party, and step 306 merely comprises selecting a streaming service to activate.

In step 308, the broadcast audio stream is replaced with the streaming audio stream. The manner of replacement varies based on the embodiment implemented on the client side. Where the client side of the system operates only on a radio or where the radio is a master, such as a car radio, the radio switches the car speaker channel between the radio's source mode (e.g., FM) to another source mode (e.g., an Internet radio streaming service). Where the radio is connected to a mobile device, the source mode may be an auxiliary (AUX) or a Bluetooth mode such that the mobile device is the source of the audio. In various embodiments, the signal to switch between source channels originates within the radio or is sent from the mobile device to the radio via application software. The signal from the mobile device to control the source channel/tuner of the radio may be sent via wired communication or wireless such as via the USB or Bluetooth protocol.

In other embodiments, such as when a personal FM transmitter is used, the broadcast audio stream from the receiver is diverted from the speakers, and the personal FM transmitter audio stream (which is from the mobile device, for example) is sent to the speakers by the radio receiver, which assumes the personal FM transmitter and the broadcast audio receiver are tuned to the same frequency.

In some embodiments, rather than switch source channels, the radio merely reduces volume from the car speakers to zero, and the mobile device activates its own native speakers (or non-native but operatively coupled speakers) to emit audio from the streaming service. Where the system operates completely on the mobile device, the switch between audio is performed via software rather than altering source channels of a radio.

In step 310, the system determines that the commercial break is ending and that the music is resuming on the broadcast audio. This determination is made similarly to the determination of step 306. The various input streams used singularly or in combination provide data that indicates that broadcast audio has resumed, or is about to resume. For example, if a commercial ends and the DJ begins talking again (e.g., identified through speaker recognition) it is likely that the broadcast audio will resume playing music soon.

This step further enables calibration of the determination of streamed audio. Where streamed audio determined in step 306 was selected poorly (based on time slot matching), the determination of step 310 is used to curtail the streamed audio of step 306 from continuing as planned.

In step 312, the audio is returned from the streaming audio to the broadcast audio. Step 312 operates in the reverse of step 308. Considerations that differ between step 312 and 308 are reintroducing the broadcast audio by either cutting off the streaming audio or allowing the current streaming song to complete before re-engaging the broadcast audio. Either setting is configured to preference of user or server administrator.

Figure 4:
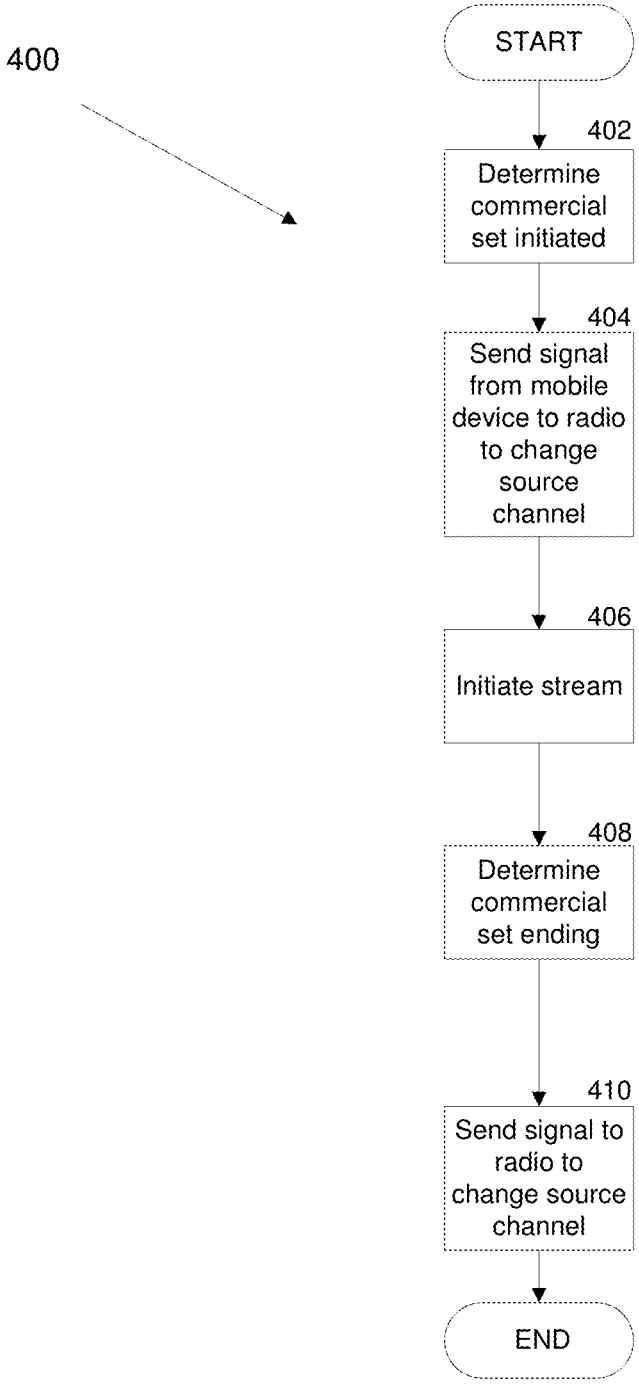
FIG. 4 is a flowchart illustrating a method for transitioning between source channels.

FIG. 4 is a flowchart illustrating a method for transitioning between source channels. In some embodiments, the system uses both a mobile device and a radio, such as a car radio. The mobile device sends control signals to the radio, and the radio provides radio broadcast signals. In step 402, the client application of the mobile device determines that a commercial set is initiating. The detection is based on any of the methods discussed herein; however, the mobile device may listen to audio emitting from car speakers via a broadcast source channel of the radio (e.g., FM radio). The listening by the mobile device enables any of the means discussed with respect to steps of FIG. 3.

In step 404, the mobile device communicates a source change to the radio. The source change directs the radio to alter its source channel from FM radio to auxiliary or wireless (e.g., in order to give the mobile phone control over the car speakers). In step 406, the mobile phone begins streaming audio. The streamed audio is emitted via car speakers using the appropriate radio source channel.

In step 408, the mobile device determines that the commercial set is ending. In some embodiments, this is determined based on a predetermined length of the commercial set (e.g., 2.5-3.5 minutes). These embodiments contemplate the possibility of being incorrect regarding the actual time of the commercial set. For example, the mobile device may estimate when the commercial set is over rather than expressly detect an exact time when the commercial set ends. The estimation may be, for example, exactly 1 or 2 songs in length.

In some embodiments, the mobile device continues to listen to the FM source channel of the radio despite that the car speakers emit audio from the mobile device. Where the FM signal is not available from a radio (e.g., no external radio available or while the source channel of a radio is shifted to the mobile device's control), the mobile device may listen to the FM signal via an FM receiver integrated into the mobile device or connected through a peripheral accessory. By listening to the broadcast radio source channel, the mobile device is able to determine accurately when the commercial set ends.

An example of a peripheral accessory as discussed above may include a simple radio with an antenna, FM tuner and a wireless (e.g., Bluetooth) capability. In this scenario, the mobile device connects to the FM tuner in the peripheral accessory via wireless capability. The mobile device (or the accessory) additionally connects to the radio/head unit through wireless capability. Client application software instructs the FM broadcast from the accessory to play through the car speakers. This removes any requirement of externally controlling the source channel for the radio as the radio can remain on the same source channel (e.g. AUX/Bluetooth) the entire time.

In step 410, the mobile device communicates a source change to the radio to return to FM radio. The source change directs the radio to alter its source channel from mobile device control of the car speakers to radio broadcast (e.g., so signals received by the car antenna emit over the car speakers).

Figure 5:
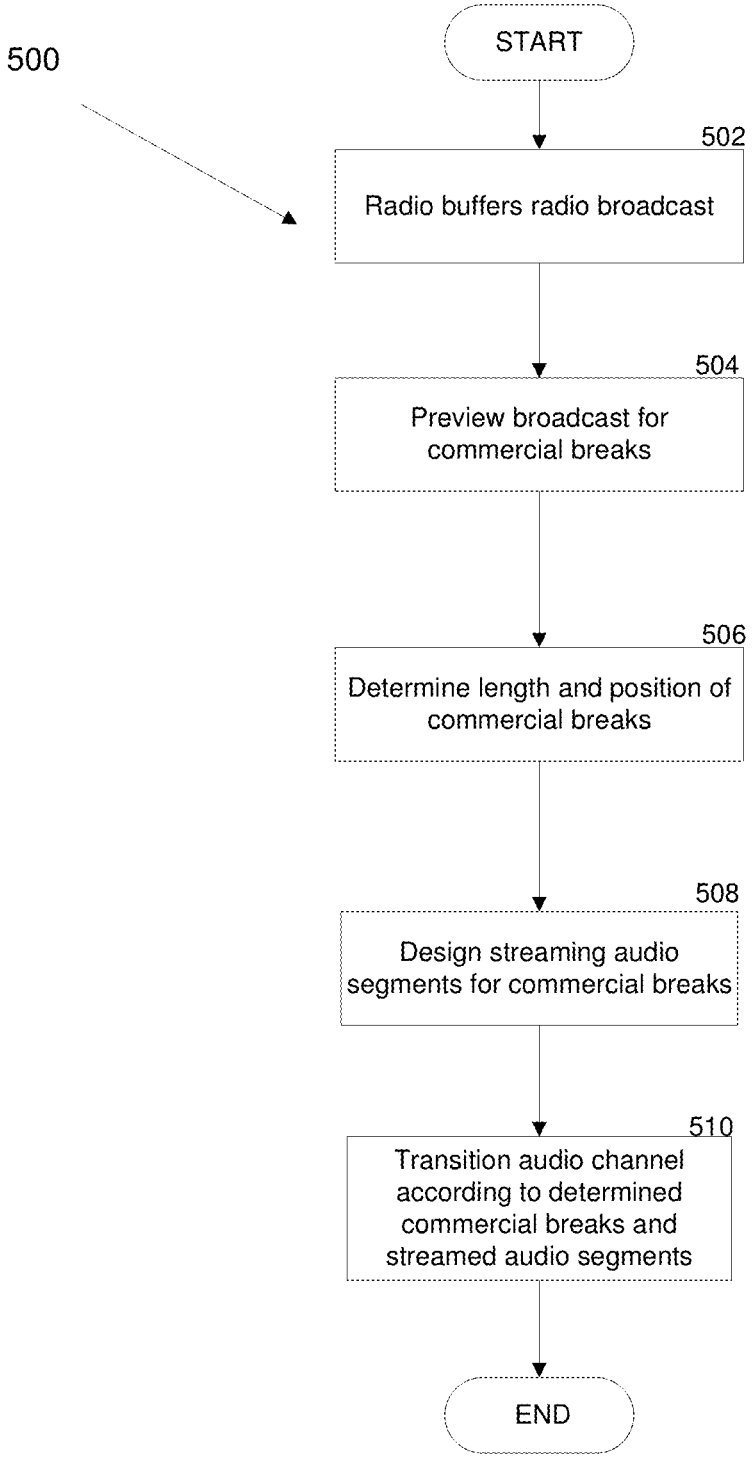
FIG. 5 is a flowchart illustrating a method for buffering a radio station to determine specifics of a commercial set.

FIG. 5 is a flowchart illustrating a method for buffering a radio station to determine specifics of a commercial set. In step 502, a radio delays emitting a received audio signal and buffers/stores the audio signal from a broadcast audio station (e.g., FM radio). In some embodiments, mobile devices include a broadcast signal receiver (e.g., FM/AM) and are enabled to function similarly to a radio system/head unit. Some mobile devices include an integrated AM/FM receiver, while others, make use of peripherals. Peripherals can be plugged into the mobile device or communicate with the mobile device wirelessly.

The audio emitted from radio speakers is delayed by the amount of the buffering. The size of the buffering ranges in length and may be reduced based on completeness of behavioral models of a radio station being buffered. The length of the buffering may also vary based on the extent of manipulation of streamed audio segments.

The purpose of buffering is to determine the content of the audio broadcast before playing the audio broadcast. This enables manipulation of audio emitted from speakers without having to analyze the radio broadcast in real-time. Example buffering lengths may vary between 10 seconds and 10 minutes. Reasoning behind various lengths is discussed below.

In some embodiments, buffering or caching broadcasts is performed by a radio/head unit. In other embodiments, the mobile device buffers the broadcast using an integrated or peripheral accessory radio receiver (e.g. FM/AM antennae/chip). In still other embodiments, a server buffers a number of radio stations simultaneously, and forwards requested stations to client devices (radios/mobile devices).

In step 504, application software analyzes the buffed broadcast signal. The broadcast signal is previewed in order to identify commercial breaks. This analysis can be performed using any of the techniques described herein and includes audio comparison to a known advertisement database, comparing receipt of broadcast metadata (RDS, RBDS) to timestamps of the broadcast, or speech recognition and semantic evaluation. In step 506, the application software determines the length and position of the commercial breaks within the buffered broadcast signal. In step 508, the application software designs an audio segment of streaming audio to match the commercial broadcast length.

In step 510, the application software transitions the audio channel of the radio between the broadcast channel and a streaming audio channel based on the known position of the commercial breaks, and streams the designed steaming audio segments. When the designed streaming audio segment completes, the application software transitions the audio channel of the radio back to the broadcast channel.

Various embodiments have different buffering lengths. Some embodiments use buffering lengths from 5-10 minutes in order to capture an entire commercial break. It is presumed that most radio stations would not run a commercial break longer than 10 minutes. However, this large buffering time reduces a user's ability to call into the radio station and interact with a broadcaster directly. Thus buffering time should be limited to the maximum necessary in order to enable the commercial replacement service. Where a behavioral profile exists for a given radio station, the buffering length may be reduced based on the system's ability to predict the length of commercial breaks.

In systems where the cached portion of the broadcast is stored on a local storage device and not delivered via a cloud or central service, the local storage system will not have a cached portion on start-up. In order to address this issue, the system may use the streaming audio channel on start-up for one or more songs to generate a buffered portion of the radio broadcast. Alternatively, other real-time analysis techniques described herein may be employed at start up until a buffered period may be established. In some embodiments, the radio broadcast is emitted via the speakers at a slightly slower speed than live/real-time in order to generate a initial start-up buffer period.

The system may reduce or extend the buffering length during use via the streaming audio segments. To extend the buffering length, additional streaming audio is included in a next upcoming streamed audio segment. This fills the time without the user being aware. Conversely, in order to reduce the buffered length, streaming audio segments are reduced or eliminated, and the buffering enables the broadcast to merely skip the entire commercial break without injecting additional audio.

Shorter buffering lengths may be used when the system conducts modification of the songs included in the streamed audio segments. For example, a buffering time need only be the length of an outro of a song if the system is programmed to repeat the outro repeatedly until the commercial break ends. When the commercial break ends (as observed by the buffered audio segment), the streamed audio segment ceases repeating the outro of the song and transitions to the broadcast audio.

Figure 6:
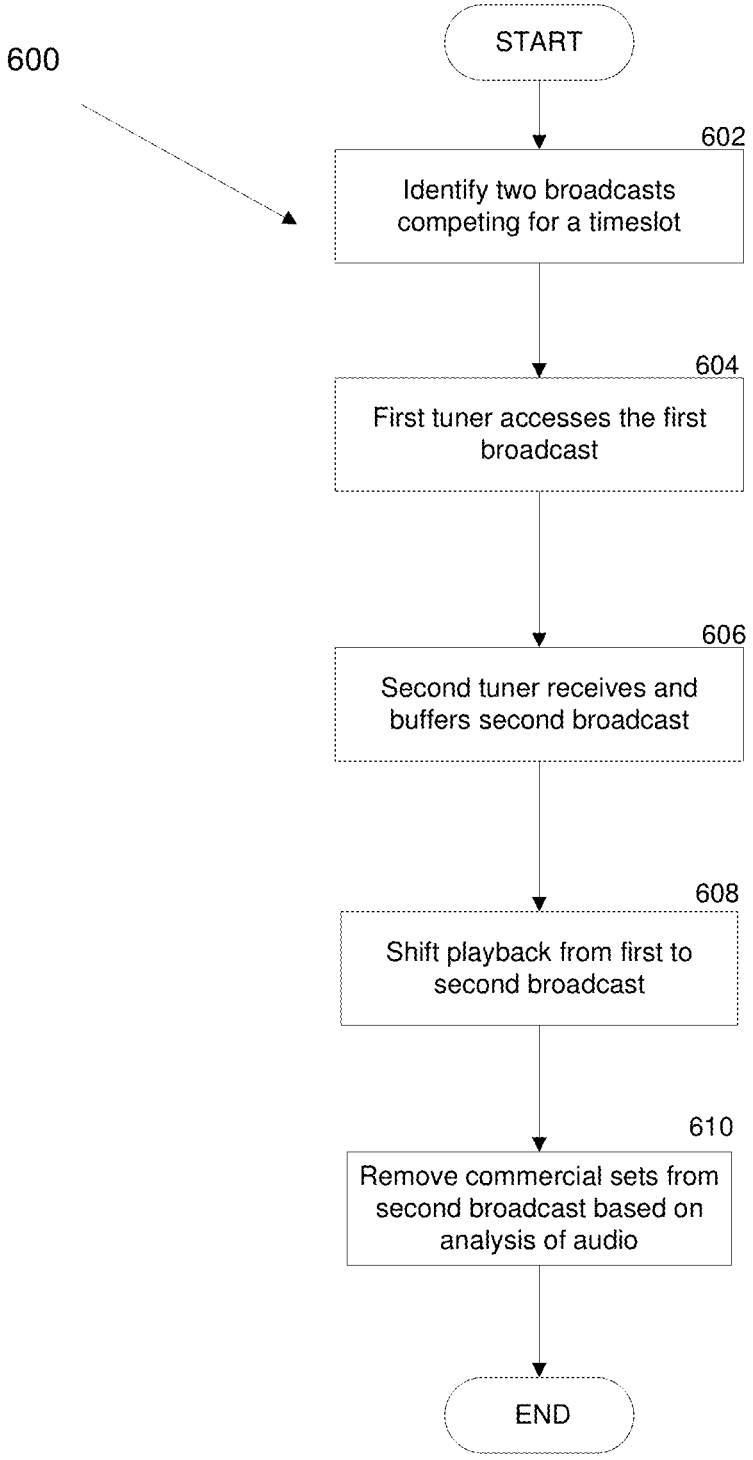
FIG. 6 is a flowchart illustrating a method for using one radio broadcast of a time cover for a second radio broadcast.

FIG. 6 is a flowchart illustrating a method for using one radio broadcast of a time cover for a second radio broadcast. In some embodiments, multiple broadcast signals may be implemented where one broadcast is listened to while the second signal is buffered. For example, in step 602, a listener tunes to a first broadcast (e.g., story on a news station), but a second broadcast (e.g., morning show on a sports station) is about to start. In step 604, a first FM tuner then plays the first broadcast (e.g., the news station) through available speakers.

In step 606, the second FM tuner caches or buffers the second broadcast (e.g., the sports station). In step 608, when the news show completes, the system shifts the available speakers to the beginning of the sports show using the cached/buffered signal. In step 610, the sports show catches up to real-time of the broadcast signal by eliminating commercial breaks and/or slightly accelerating playback. Commercial sets are identified via analysis of the buffered audio.

The two radio tuners are available via a radio's native tuner and a mobile device's integrated or peripheral receivers (e.g., FM antennae/chip). Memory/storage for the buffered/cached audio is readily available on many mobile devices, though radios may be configured to have suitable memory/storage.

Figure 7:
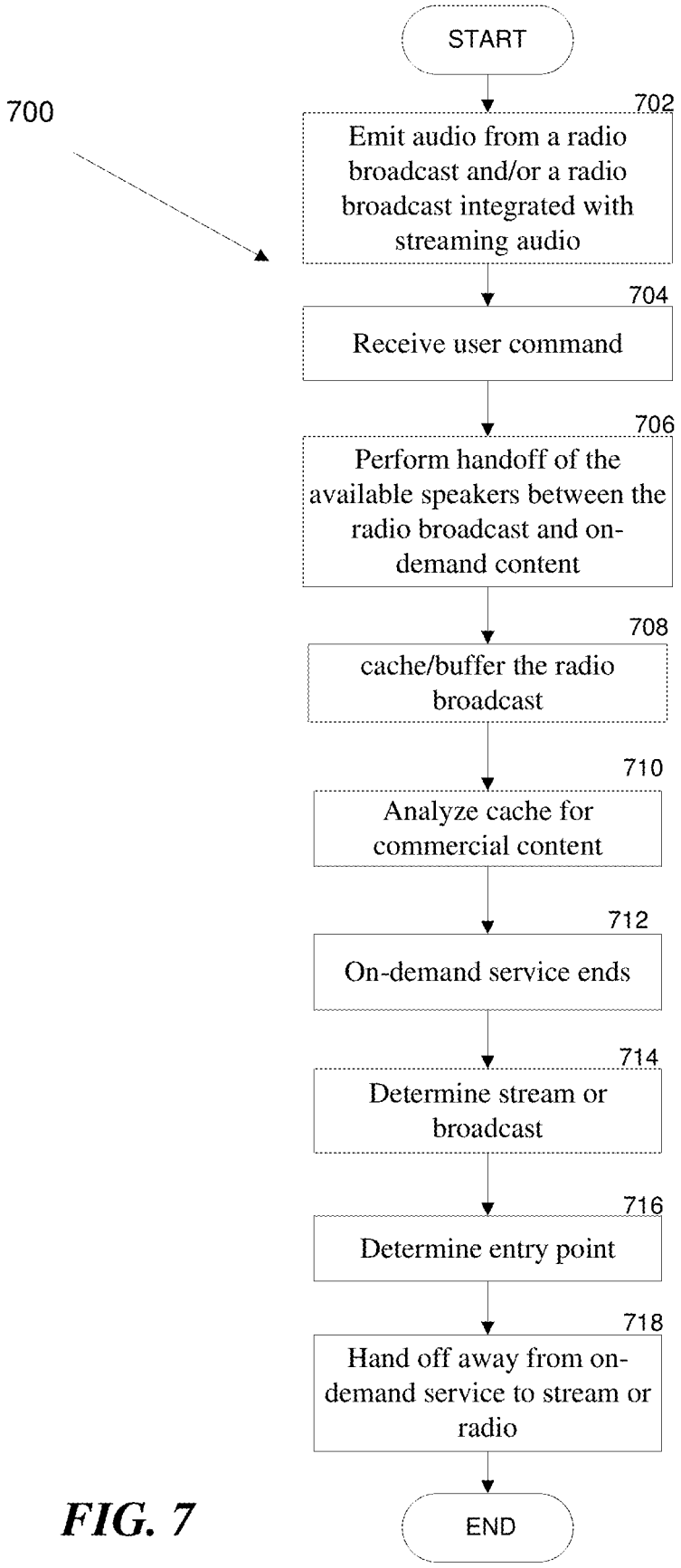
FIG. 7 is a flowchart illustrating a handoff from a broadcast to on demand content.

FIG. 7 is a flowchart illustrating a handoff from a broadcast to on demand content. In step 702, a set of available speakers emits audio from a radio broadcast and/or a radio broadcast integrated with streaming audio (as described above). In step 704, the system receives user input such as an issued command (e.g., via voice commands, physical input, etc.) to request on-demand content. The on-demand content includes news/weather/traffic conditions/driving directions/etc. Voice commands may be issued via a mobile device or a stereo system. Many automobiles include voice activated controls (sometimes activated by a button press). Mobile devices or connected home assistants include wake up phrases to initiate voice control (e.g., Android and Google Home operate from "Ok, Google", The Amazon Echo responds to "Alexa", and Apple iOS responds to "Hey, Siri").

In step 706, the system performs a handoff of the available speakers between the radio broadcast and the on-demand content. In some embodiments, the hand off is performed in response to the issued command for on-demand content. I some embodiments, such as driving directions, the system initiates the hand off based on an indication from the on-demand content. For example, an initial command is to providing driving directions to a given location. Initial instructions are provided at that time, but then, other instructions are provided along the way based on the location of the car. For each of the additional instructions, a radio broadcast/on-demand content hand off occurs. The hand off occurs according to any of the methods described herein on any of the system configurations disclosed herein.

The on-demand services may be implemented directly with a hand-off service as a single integrated service (e.g., a command is issued to the hand off system, and the hand off system provides the on-demand service) or via a third party API. To use a third party API, a user uses a wake up phrase associated with the hand off service, and then issues a command. The hand off service forwards the command to the third party API (e.g., assistant software offered by Amazon, Google, or Apple). The third party executes on the command and returns an audio-based output. The audio-based output from the third-party assistant is handled by the hand off system and delivered to the user via available local speakers. This operates similarly to how the hand off service may call out to a third party service for streaming audio music.

In step 708, while the on-demand service controls the available speakers, the system caches/buffers the radio broadcast. Note, that in circumstances where the on-demand service is requested while the system is playing streamed audio rather than a radio broadcast, the system will have already begun manipulating the cached/buffered radio broadcast audio (e.g., either increasing the length of the cache or "spending" it to approach real-time).

In step 710, the cached radio broadcast is analyzed for commercial content. The analysis is performed similarly to methods described herein. In step 712, the on-demand service ends use and a "return" hand off is performed. The on-demand service ceases based on a completion of service, or an end command issued by the user. For example, where the on-demand service is a news report, the report plays to completion and the on-demand service is over. Conversely, an on-demand service may provide conversational features and continue operation until the user completes or tires of the conversation (e.g., "Alexa, let's play twenty questions . . . ugh, never mind, Alexa, stop"). In either circumstance, when the on-demand service completes, a hand off is performed back to either streamed audio or the radio broadcast.

In step 714, the system, determines whether to hand off back to streamed audio or radio broadcast. The determination is based on a number of factors. One factor is the size/length of the cache. Where the system seeks to grow the cache, the system will hand off to streamed audio. Where the cache is of suitable size for analysis out of real-time (e.g., enough time such that the beginning and end of commercial breaks may be reliably identified), the hand off may return to the radio broadcast.

Another factor is the smoothness of transition. Where the on-demand service was called during a particular song from one output, in some circumstances it is an ideal user experience to complete the song. Where the on-demand service takes a limited amount of time (e.g., <30 seconds) the user may be eager to return to the song that had been playing. Where the on-demand service occupies a larger portion of time (e.g., determined by a threshold) the user may have forgotten about or lost interest in the previous song. Returning to the middle or end of the song may be jarring. The threshold in determining whether the experience is deemed "jarring" by the system may vary based on the remaining time in the song. For example, if 2 seconds remain in the song, the threshold for returning to the song as opposed to playing audio from a new/next song is lower than if 30 seconds remain in the song.

In some embodiments, streamed audio uses the same speaker channel as the on-demand service. Thus, the "hand off" is between data sources (e.g., between cloud servers and third party APIs) rather than transceiver hardware.

In step 716, the system determines the point of return for the handoff. The point of return refers to where (e.g., timestamp) in the cached radio broadcast or streamed audio track the hand off is placed. The point of return may vary based on a number of factors related to transition smoothness. As noted above, the hand off may return to an in-progress song where the song was interrupted. Alternatively, the system may opt to move on to a next song. Increases in the length of on-demand service increase the chance that the hand off will transition to the next song. Increased proximity of the on-demand "exit time" to the beginning or end of a song increases the chances that the hand off will transition to the next song. Where a hand off is to the next song, the system either queues up the next song in from the streaming audio, or uses the cache of the radio broadcast and audio analysis to determine when the next song starts (so as to skip dead air).

In step 718, the system executes the return handoff.

Figure 8:
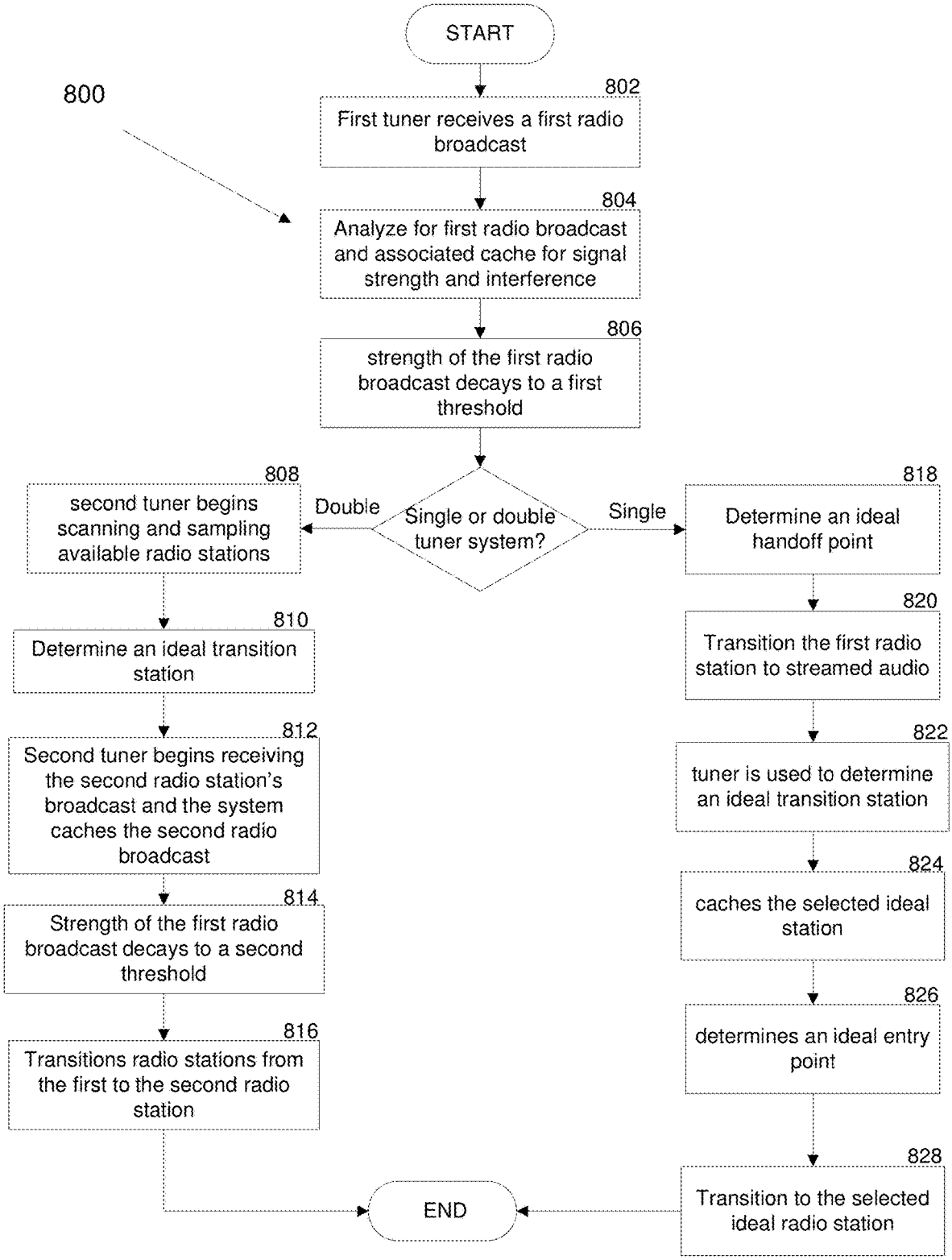
FIG. 8 is a flowchart illustrates automatic transition between radio stations.

FIG. 8 is a flowchart illustrates automatic transition between radio stations. When a user is driving long distances radio stations tend to go in and out of service. Further the driver often enters areas where they are unfamiliar with the radio stations. This creates an issue for drivers in locating and selecting an active radio station while in a given area. A way to resolve this issue makes use of two radio tuners/antennae.

In step 802 the first tuner receives a first radio broadcast from a first station. The first radio broadcast is active on the available local speakers. The first radio broadcast functions with integrated streamed audio and/or on-demand services as described above. The first radio broadcast is cached as described above. In step 804, the first radio broadcast and the cache of the first radio broadcast is analyzed for signal strength and interference. The analysis may be performed by the radio hardware (detecting signal strength directly), analysis of audio of the cached first radio broadcast (e.g., by detecting static or interfering audio), or both.

In step 806, the strength of the first radio broadcast decays to a first threshold. The first threshold is approached from greater signal strength to lower signal strength. Where the system initially detects that the first radio broadcast is below the first threshold, the first threshold is determined as satisfied.

In step 808, in response to reaching the first threshold, the second tuner begins scanning and sampling available radio stations. Scanning available radio stations determines relative strength of other available radio stations as compared to the first radio station. The relative strength of stations can be expressed both as a static value, and as a slope, as a car drives closer or further from a given radio station the strength will increase or decrease respectively. Even if the current strength is high, the station strength may be decaying (as indicated by the slope). The system records each of these data points.

Sampling the other available radio stations enables the system to determine the content of the other radio stations. Sampling may be performed via audio analysis or metadata analysis (e.g., RDS, RDBS). Either the radio itself (head-unit) or a mobile device with a communicative connection to the radio may perform the audio analysis.

In step 810, the system determines an ideal transition station. An ideal station is defined as one having content similar to the first radio station, or content similar to a user preference profile, and a signal strength greater than a predetermined threshold and signal decay rate within another associated predetermined threshold (maximum negative slope). If there are multiple "ideal" stations, a single "most ideal" station may be chosen based on a number of factors. Factors include a given station having a partner program with an administrator of the system; metadata of the given station indicating that the given station is playing a commercial free block of music (therefore requiring less streamed audio to cover commercial sets); overall signal strength comparisons; and a determination that a given station is the "most similar" to the current, first radio station. A station may be determined "most similar" based on having a matching music style. The most similar factor is relevant when multiple ideal stations are selected identified on a user preference profile identifying multiple styles of music.

In step 812, once a single ideal station has been selected as the second radio station, the second tuner begins receiving the second radio station's broadcast and the system caches the second radio broadcast.

In step 814, the strength of the first radio broadcast decays to a second threshold. The second threshold is approached from greater signal strength to lower signal strength. The second threshold is below the first threshold. The second threshold is indicative of a station with a weak signal that is harmful to the user experience/enjoyment.

In step 816, the system transitions radio stations from the first to the second radio station. When transitioning, the system may announce to the user, or cover the transition using streamed audio. Where there are no "ideal" radio stations, the system may play continuous streamed audio until there is an ideal station. Hand off between streamed audio and radio broadcasts is handled as described above.

In an alternate embodiment, the system uses a single tuner to achieve a similar effect. In step 808, where the first radio station meets the first signal strength decay threshold, where there is only a single tuner, the method proceeds to step 818 rather than step 810.

In step 818, the system determines an ideal handoff point. The ideal handoff point coincides with the end of a current song on the first radio broadcast. In step 820, the system transitions the first radio station to streamed audio. In step 822, the first (and only) tuner is used to determine an ideal transition station. This step is performed in the same manner as step 810, merely with the first (and only) tuner.

In step 824, the system caches the selected ideal station as performed in step 812. In step 826, in response to the selected ideal station completing a caching phase, the system determines an ideal entry point to the selected ideal station and an ideal exit point of the streamed audio.

The ideal entry point is determined based on the beginning of a cached song as determined by audio analysis and/or metadata (e.g., RDS, RDBS). If there are multiple beginnings of songs cached, the earliest (based on broadcast timestamp) is chosen as the ideal entry point. The ideal exit point of the streamed audio is based off the ending of a current song or the completion of an on-demand service use that abandons the current streamed audio song partway through completion (see FIG. 7).

In step 828, in response to identification of an ideal entry point and identification of an ideal exit point, the system transitions from the streamed audio (and/or on-demand service) to the selected ideal radio station. In some circumstances, the steps pertaining to each of the two styles of system (single or double tuner) may be used with the other system where appropriate. For example, identification of ideal entry and exit points may be determined regardless of system style. In some embodiments, the first threshold (of step 806) may differ between single and double tuner systems.

Figure 9:
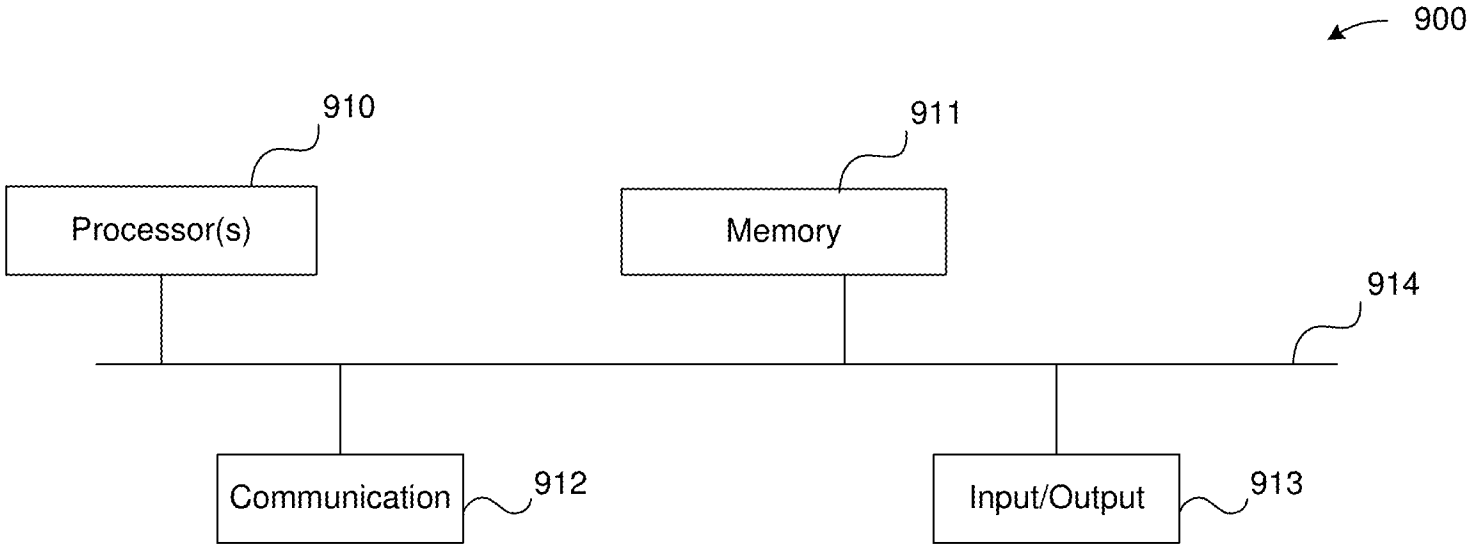
FIG. 9 is a block diagram of an exemplary computer system.

FIG. 9 is a high-level block diagram showing an example of a processing device that can represent a system to run any of the methods/algorithms described above. A system may include two or more processing devices such as represented in FIG. 6, which may be coupled to each other via a network or multiple networks. A network can be referred to as a communication network.

In the illustrated embodiment, the processing device 900 includes one or more processors 910, memory 911, a communication device 912, and one or more input/output (I/O) devices 913, all coupled to each other through an interconnect 914. The interconnect 914 may be or include one or more conductive traces, buses, point-to-point connections, controllers, scanners, adapters and/or other conventional connection devices. Each processor 910 may be or include, for example, one or more general-purpose programmable microprocessors or microprocessor cores, microcontrollers, application specific integrated circuits (ASICs), programmable gate arrays, or the like, or a combination of such devices. The processor(s) 910 control the overall operation of the processing device 900. Memory 911 may be or include one or more physical storage devices, which may be in the form of random access memory (RAM), read-only memory (ROM) (which may be erasable and programmable), flash memory, miniature hard disk drive, or other suitable type of storage device, or a combination of such devices. Memory 911 may store data and instructions that configure the processor(s) 910 to execute operations in accordance with the techniques described above. The communication device 912 may be or include, for example, an Ethernet adapter, cable modem, Wi-Fi adapter, cellular transceiver, Bluetooth transceiver, or the like, or a combination thereof. Depending on the specific nature and purpose of the processing device 900, the I/O devices 913 can include devices such as a display (which may be a touch screen display), audio speaker, keyboard, mouse or other pointing device, microphone, camera, etc.

Unless contrary to physical possibility, it is envisioned that (i) the methods/steps described above may be performed in any sequence and/or in any combination, and that (ii) the components of respective embodiments may be combined in any manner.

The techniques introduced above can be implemented by programmable circuitry programmed/configured by software and/or firmware, or entirely by special-purpose circuitry, or by a combination of such forms. Such special-purpose circuitry (if any) can be in the form of, for example, one or more application-specific integrated circuits (ASICs), programmable logic devices (PLDs), field-programmable gate arrays (FPGAs), etc.

Software or firmware to implement the techniques introduced here may be stored on a machine-readable storage medium and may be executed by one or more general-purpose or special-purpose programmable microprocessors. A "machine-readable medium", as the term is used herein, includes any mechanism that can store information in a form accessible by a machine (a machine may be, for example, a computer, network device, cellular phone, personal digital assistant (PDA), manufacturing tool, any device with one or more processors, etc.). For example, a machine-accessible medium includes recordable/non-recordable media (e.g., read-only memory (ROM); random access memory (RAM); magnetic disk storage media; optical storage media; flash memory devices; etc.), etc.

Physical and functional components (e.g., devices, engines, modules, and data repositories, etc.) associated with the processing device can be implemented as circuitry, firmware, software, other executable instructions, or any combination thereof. For example, the functional components can be implemented in the form of special-purpose circuitry, in the form of one or more appropriately programmed processors, a single board chip, a field programmable gate array, a general-purpose computing device configured by executable instructions, a virtual machine configured by executable instructions, a cloud computing environment configured by executable instructions, or any combination thereof. For example, the functional components described can be implemented as instructions on a tangible storage memory capable of being executed by a processor or other integrated circuit chip (e.g., software, software libraries, application program interfaces, etc.). The tangible storage memory can be computer readable data storage. The tangible storage memory may be volatile or non-volatile memory. In some embodiments, the volatile memory may be considered "non-transitory" in the sense that it is not a transitory signal. Memory space and storages described in the figures can be implemented with the tangible storage memory as well, including volatile or non-volatile memory.

Note that any and all of the embodiments described above can be combined with each other, except to the extent that it may be stated otherwise above or to the extent that any such embodiments might be mutually exclusive in function and/or structure.

Although the present invention has been described with reference to specific exemplary embodiments, it will be recognized that the invention is not limited to the embodiments described but can be practiced with modification and alteration within the spirit and scope of the appended claims. Accordingly, the specification and drawings are to be regarded in an illustrative sense rather than a restrictive sense.

The invention claimed is:

1. A method comprising:

storing a radio broadcast to a memory cache, thereby generating a first stored radio broadcast;

playing the first stored radio broadcast through a speaker at a delay, causing audible play of a delayed radio broadcast;

preemptively executing an audio analysis on the first stored radio broadcast before playing as the delayed radio broadcast wherein the audio analysis identifies a timestamp and a length of a first commercial set;

generating a replacement media set from a library of on-demand audio based on a set of user preferences and the length of the first commercial set; and transitioning an audio channel of the speaker from the delayed radio broadcast to the replacement media set for a period matching the length of the first commercial set.

2. The method of claim 1, wherein the on-demand audio is a portion of a second stored radio broadcast, the second delayed stored radio broadcast having a different channel than the first stored radio broadcast.

3. The method of claim 1, wherein the replacement media set is of a greater length than the length of the first commercial set, and wherein said transitioning step increases the delay of the delayed radio broadcast.

4. The method of claim 3, further comprising:

identifying that the delay has reached a specified threshold;

preemptively executing an audio analysis on the first stored radio broadcast before playing as the delayed radio broadcast wherein the audio analysis identifies a set of bounds of a second commercial set; and skipping playback of the second commercial set via a reduction of the delay of the delayed radio broadcast based on the set of bounds.

5. The method of claim 1, further comprising:

improving a match between the replacement media set and the length of the first commercial set by digitally altering a play speed of the replacement media set, wherein the play speed changes a length of songs included within the replacement media set.

6. The method of claim 1, wherein said transitioning further includes:

shifting a source of an input signal of the speaker between the stored radio broadcast and a wireless transceiver that communicates with a wireless network connected to the Internet.

7. The method of claim 1, wherein the delay of the delayed radio broadcast is further based on a length of songs included within the library of on-demand audio.

8. The method of claim 1, further comprising:

digitally altering a play speed of the on-demand audio wherein the play speed changes a length of songs included within the on-demand audio.

9. The method of claim 8, wherein said digital altering of the play speed results in a reduction of a total time of the delay of the delayed radio broadcast.

10. The method of claim 1, further comprising:

directing control of a car radio via a mobile device application.

11. The method of claim 1, wherein said audio analysis further comprises:

generating a text segment via speech recognition on the first stored radio broadcast;

evaluating the text segment for a description of a length of the commercial set; and applying a timer relative to said timestamp, the timer having the length of the commercial set.

12. A system comprising:

a processor; and a memory including instructions that when executed cause the processor to:

store a radio broadcast to a memory cache, thereby generating a first stored radio broadcast;

play the first stored radio broadcast through a speaker at a delay, causing audible play of a delayed radio broadcast;

preemptively execute an audio analysis on the first stored radio broadcast before playing as the delayed radio broadcast wherein the audio analysis identifies a timestamp and a length of a first commercial set;

generate a replacement media set from a library of on-demand audio based on a set of user preferences and the length of the first commercial set; and transition an audio channel of the speaker from the delayed radio broadcast to the replacement media set for a period matching the length of the first commercial set.

13. The system of claim 12, further comprising:

a FM radio antenna configured to receive the radio signal; and a wireless transceiver configured to receive the on-demand audio via a wireless network connected to the Internet.

14. The system of claim 13, wherein the processor includes a first processor and a second processor, the system further comprising:

a radio control unit including the first processor, the radio control unit in control over the speaker and the FM radio antenna; and a mobile device including the second processor, the mobile device in communication with the radio control unit and including the wireless transceiver.

15. The system of claim 14, wherein the speaker includes:

a first speaker controlled by the radio control unit and configured to play the radio signal; and a second speaker controlled by the mobile device and configured to play the on-demand audio.

* * * * *